US008302547B2

(12) United States Patent
Tseng et al.

(10) Patent No.: US 8,302,547 B2
(45) Date of Patent: Nov. 6, 2012

(54) THREAD CUTTING DEVICE FOR A SEWING MACHINE

(75) Inventors: Shui-Chun Tseng, Taiping (TW); Hsueh-Hua Liu, Taiping (TW)

(73) Assignee: Zeng Hsing Industrial Co., Ltd., Taiping, Taichung Hsien (TW)

( * ) Notice: Subject to any disclaimer, the term of this patent is extended or adjusted under 35 U.S.C. 154(b) by 56 days.

(21) Appl. No.: 13/006,863

(22) Filed: Jan. 14, 2011

(65) Prior Publication Data

US 2012/0180709 A1 Jul. 19, 2012

(51) Int. Cl.
*D05B 65/00* (2006.01)

(52) U.S. Cl. ..... 112/291

(58) Field of Classification Search ..... 112/291, 112/292, 231, 296, 297, 298, 248, 285, 289, 112/475.01, 475.17, 475.18
See application file for complete search history.

(56) References Cited

U.S. PATENT DOCUMENTS 4,630,559 A * 12/1986 Kinoshita ..... 112/291
4,726,305 A * 2/1988 Seto ..... 112/298
5,481,994 A * 1/1996 Ku ..... 112/298
5,870,962 A * 2/1999 Ku ..... 112/292

* cited by examiner

*Primary Examiner* — Tejash Patel
(74) *Attorney, Agent, or Firm* — Kirton McConkie; Evan R. Witt

(57) ABSTRACT

A thread cutting device is adapted to be mounted under a bed of a sewing machine, and includes a mount having a marginal region which confronts a thread fetching zone, and a guide slot which is elongated parallel to a stroke path, a fixed knife disposed on the marginal region and having a blade aligned with the stroke path, a movable knife having a shank body which extends along the stroke path to terminate at actuated and hook ends, a drive unit disposed under the mount and having a rotatable output shaft to deliver a rotational force, and a rotation/translation conversion mechanism disposed to convert the rotational force into a translational force that is transmitted through the guide slot to actuate a translation of the actuated end of the shank body to thereby move the shank body between fetching and thread cutting positions.

6 Claims, 6 Drawing Sheets

THREAD CUTTING DEVICE FOR A SEWING MACHINE

BACKGROUND OF THE INVENTION

1. Field of the Invention

This invention relates to a sewing machine, more particularly to a thread cutting device for a sewing machine.

2. Description of the Related Art

Conventionally, a thread cutting mechanism for a sewing machine generally includes a large number of linking members connected to drive two cutters to respectively cut a needle thread and a bobbin thread. Such thread cutting mechanism has a complicated structure, rendering manufacturing costs quite high.

Another thread cutting device of a sewing machine includes a plurality of gears and linkages driven by a servomotor to move a cutter to simultaneously cut a needle thread and a bobbin thread. Since interlocking of the gears and linkages is complicated to ensure back and forth movements of the cutter, assembly and machine maintenance of such thread cutting device are inconvenient to conduct.

SUMMARY OF THE INVENTION

An object of the present invention is to provide a thread cutting device for a sewing machine which has a simple construction and which can simultaneously cut a needle thread and a bobbin thread.

According to this invention, the thread cutting device includes a mount adapted to be mounted under a table of a sewing machine, and having a marginal region which is disposed to confront a thread fetching zone. The mount has an upper major surface which defines a stroke path that extends toward the marginal region and which has a guide slot that extends through a lower major surface of the mount, and that extends parallel to the stroke path. A fixed knife is disposed on the marginal region and includes a blade oriented in alignment with the stroke path. A movable knife includes a shank body extending along the stroke path to terminate at an actuated end and a hook end with a hook cavity. The shank body is disposed to be movable along the stroke path between a fetching position, where the hook end takes up a thread tensed in the thread fetching zone by engaging the thread in the hook cavity, and a thread cutting position, where the cavity-engaging thread is cut by virtue of sweeping movement of the hook end relative to the blade. A drive unit has an output shaft disposed under the lower major surface of the mount to deliver a rotational force. A rotation/translation conversion mechanism is disposed to convert the rotational force into a translational force, and is configured to transmit the translation force through the guide slot so as to actuate a translation of the actuated end of the movable knife to thereby move the shank body between the fetching and thread cutting positions.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
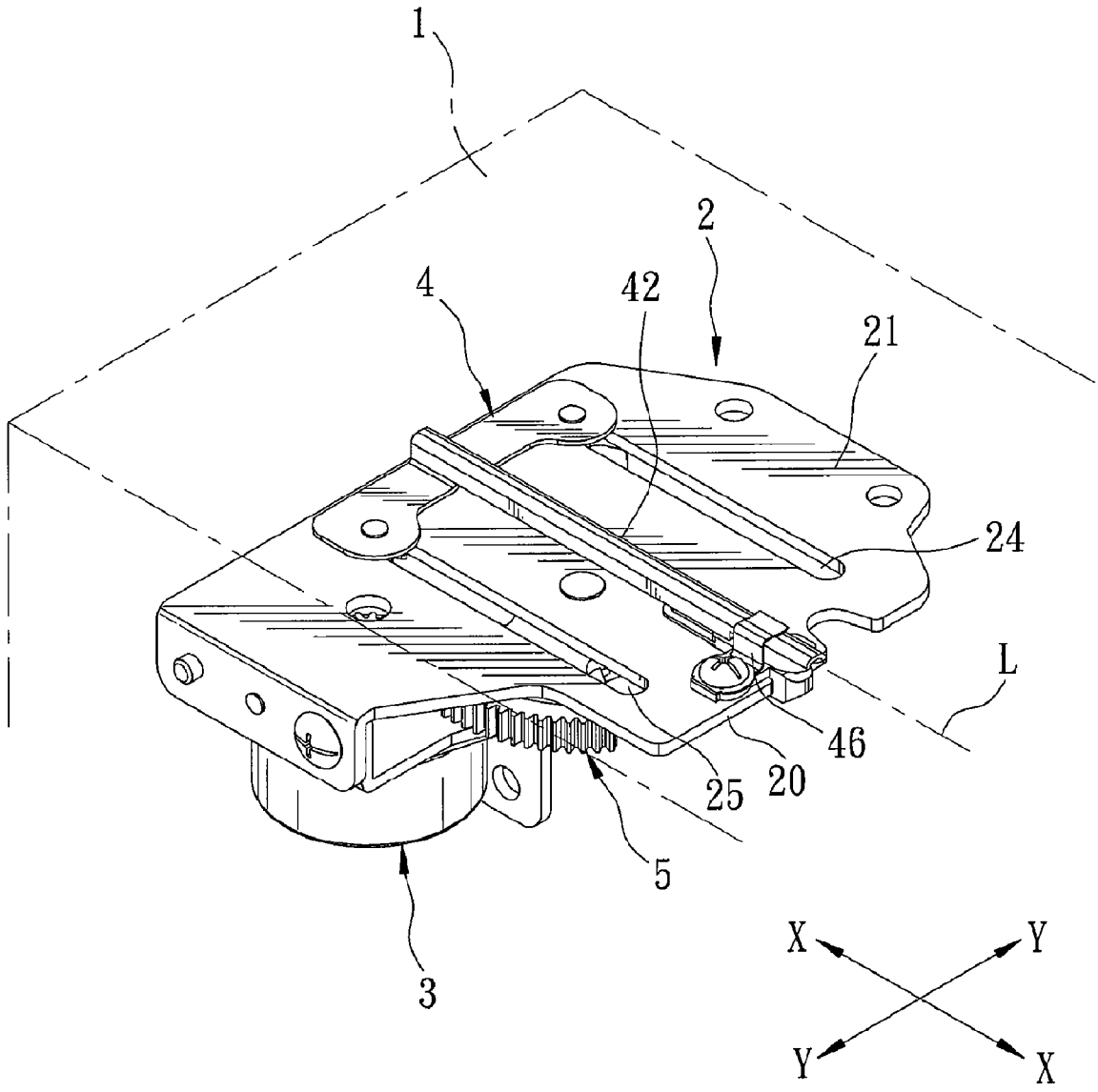
FIG. 1 is a perspective view of the preferred embodiment of a thread cutting device for a sewing machine according to this invention.
Figure 2:
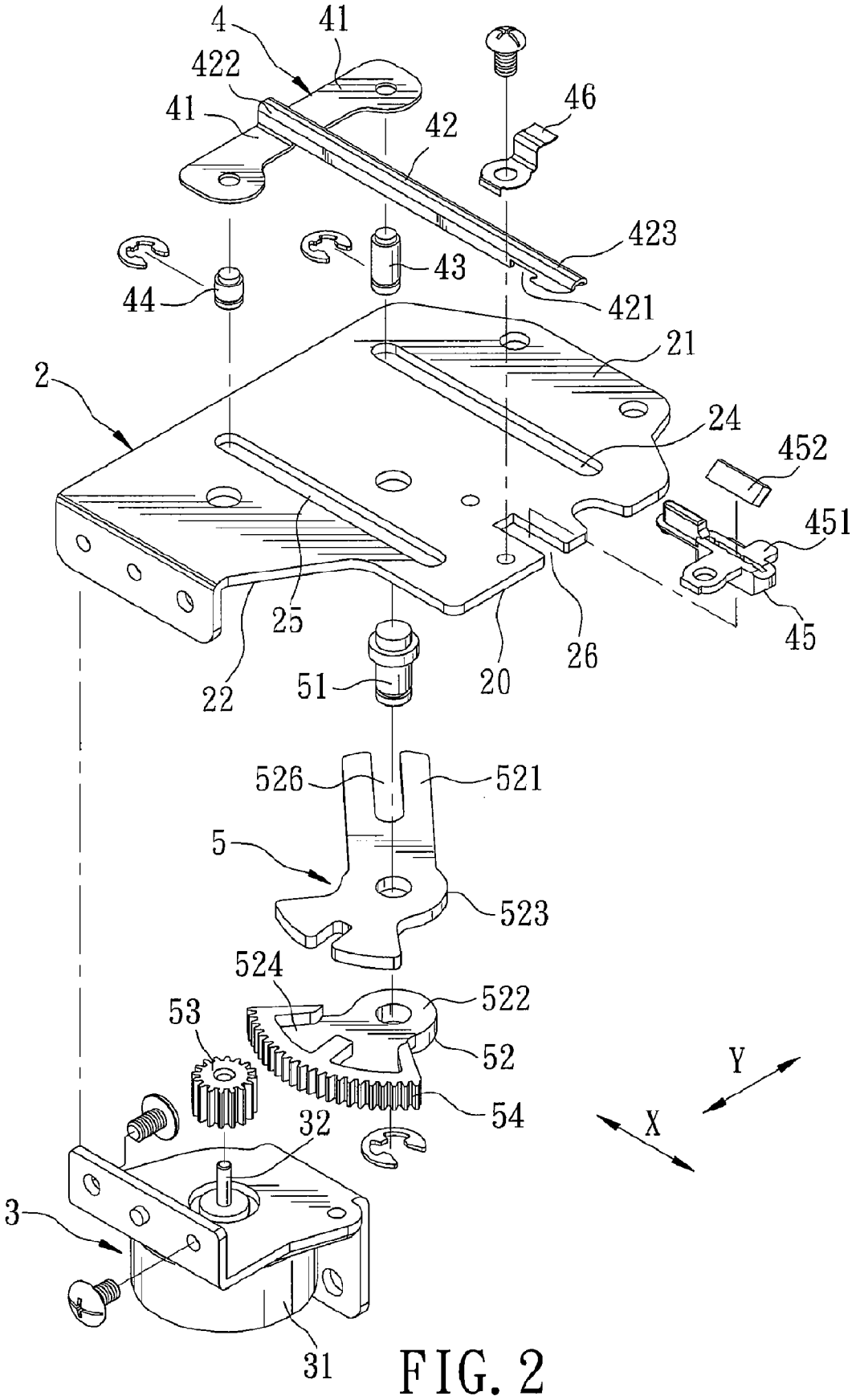
FIG. 2 is an exploded perspective view of the preferred embodiment.
Figure 3:
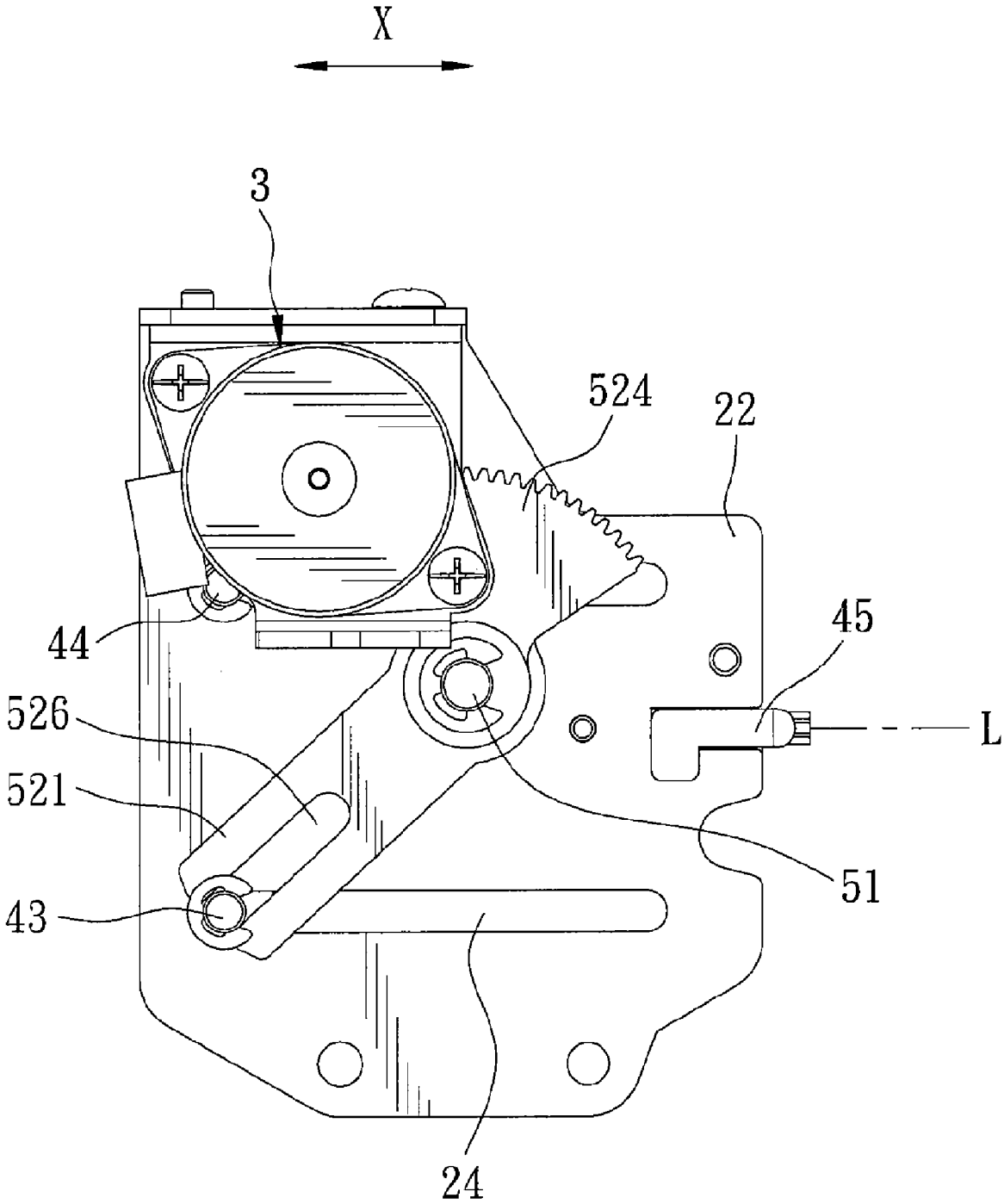
FIG. 3 is a bottom view of the preferred embodiment.

Referring to FIGS. 1 to 3, the preferred embodiment of a thread cutting device for a sewing machine according to the present invention is shown to comprise a mount 2, a drive unit 3, a cutting unit 4, and a rotation/translation conversion mechanism 5. The sewing machine generally includes a table 1 fitted with a needle plate, and a hook assembly spaced apart from the needle plate in an upright direction to define a thread fetching zone.

The mount 2 is adapted to be mounted under the table 1 of the sewing machine, and has a marginal region 20 which extends in a direction transverse (Y) to the upright direction, and which is disposed to confront the thread fetching zone. The mount 2 has a lower major surface 22 and an upper major surface 21 which defines a stroke path (L) that extends toward a cutout 26 of the marginal region 20 in a longitudinal direction (X) transverse to the upright direction and the transverse direction (Y). The upper major surface 21 has a guide slot 24 and an auxiliary slot 25 which extend through the lower major surface 22, and which are elongated parallel to and disposed at two sides of the stroke path (L).

The drive unit 3 is disposed under the lower major surface 22, and is in the form of a motor which includes a housing 31 and an output shaft 32. The output shaft 32 is rotated about an upright axis to deliver a rotational force.

The cutting unit 4 includes a fixed knife 45, a movable knife, and a shank guiding member 46.

The fixed knife 45 includes a blade seat 451 affixed to the cutout 26 of the marginal region 20, and a blade 452 mounted on the blade seat 451 and oriented in alignment with the stroke path (L).

Figure 4:
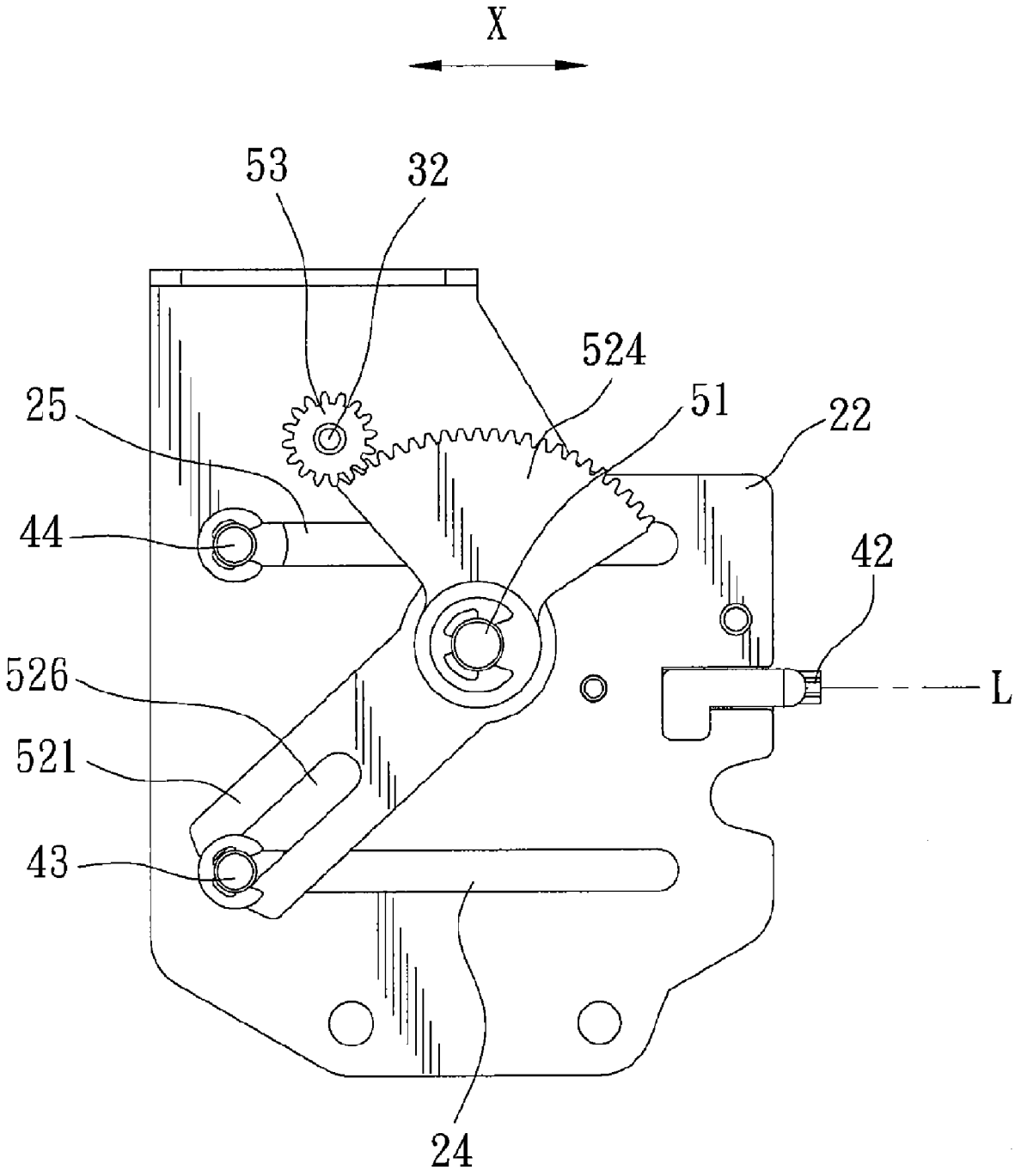
FIG. 4 is a bottom view illustrating a movable knife in a thread cutting position.
Figure 5:
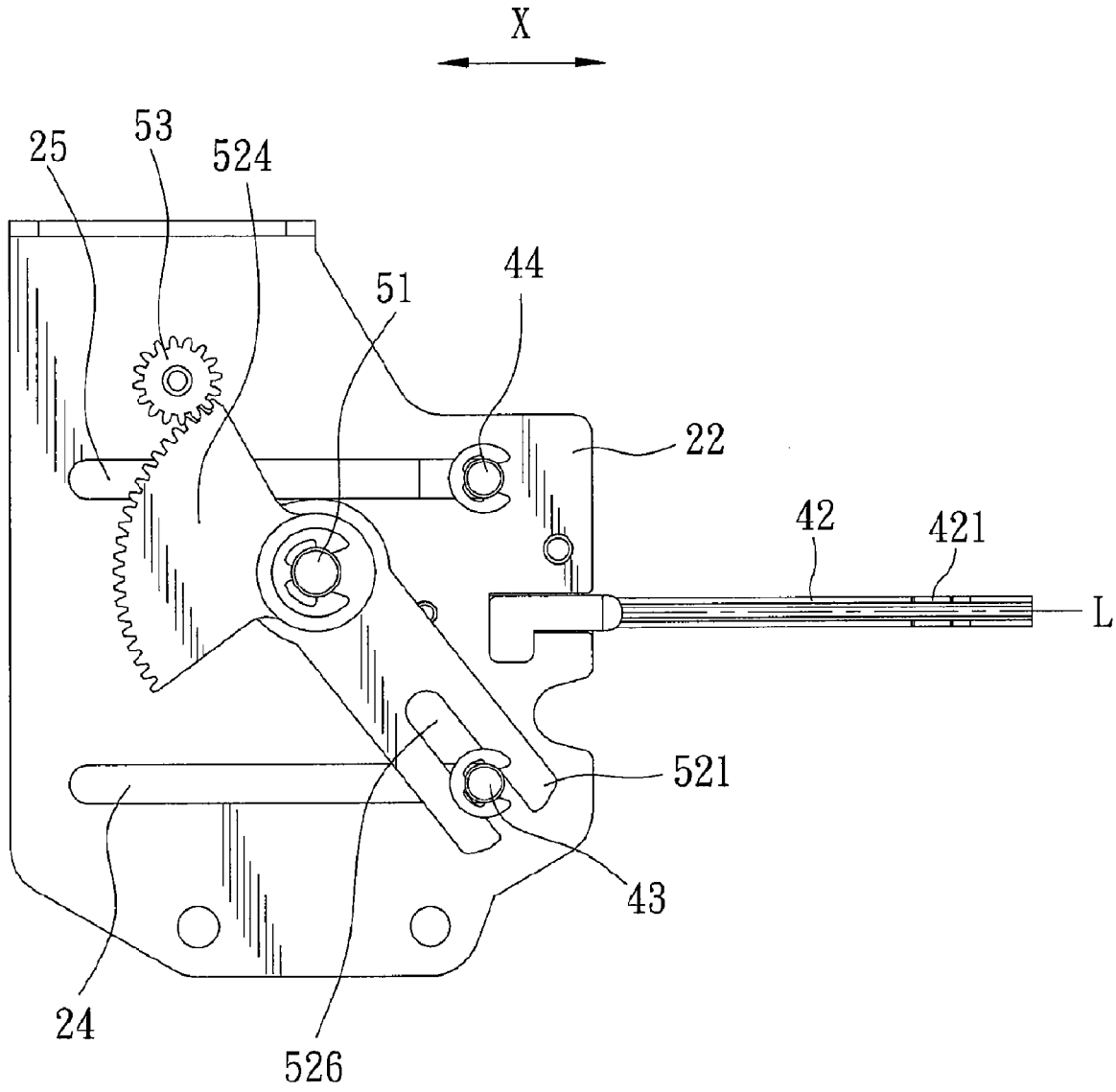
FIG. 5 is a bottom view illustrating the movable knife in a fetching position.
Figure 6:
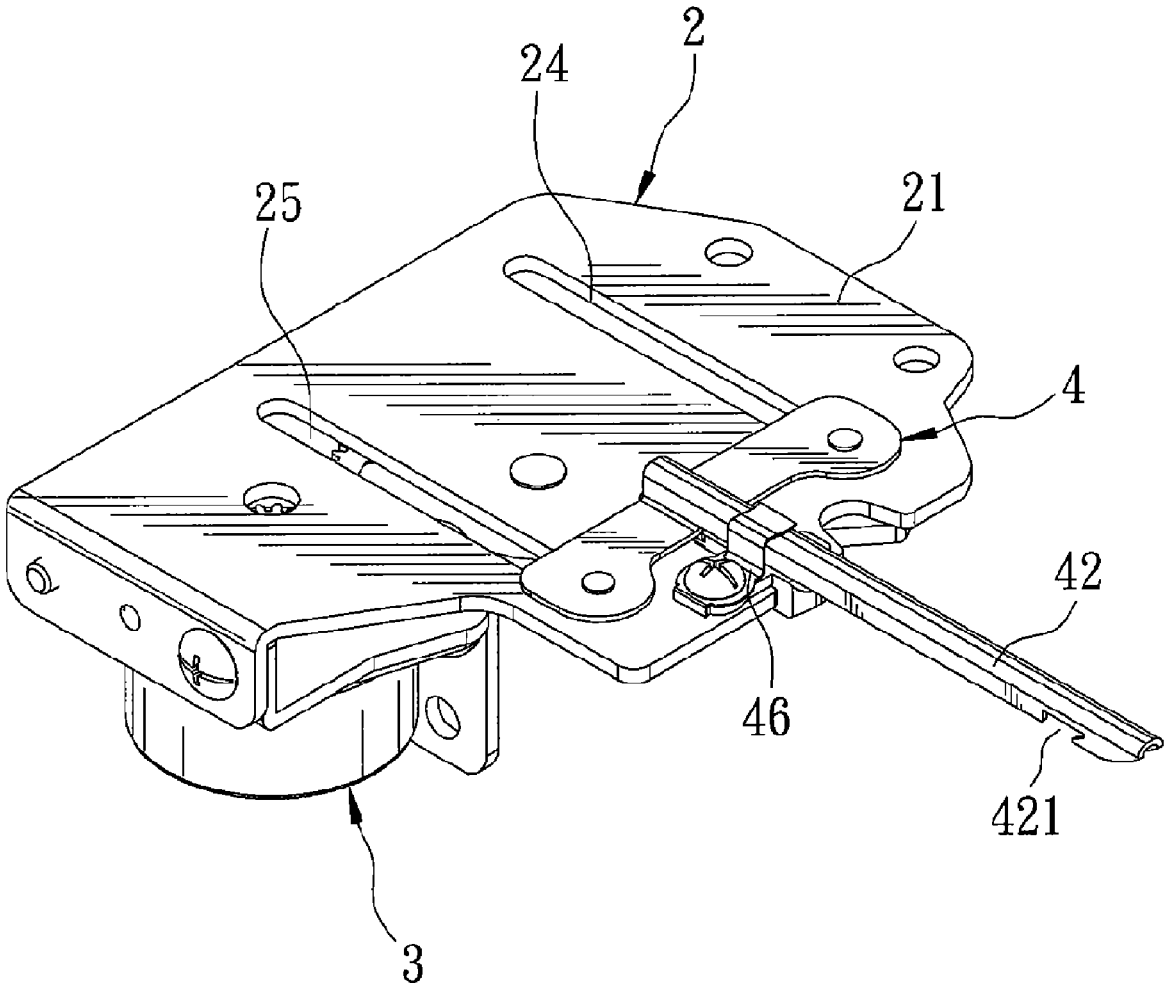
FIG. 6 is another perspective view illustrating the movable knife in the fetching position.

The movable knife includes a shank body 42 which extends in the longitudinal direction (X) to terminate at an actuated end 422 and a hook end 423, and left and right wing portions 41 extending from the actuated end 422 in the transverse direction (Y). A key 43 and a protrusion 44 are respectively mounted on the left and right wing portions 41 and extend downwardly to engage in the guide slot 24 and the auxiliary slot 25. By sliding movement of the key 43 and the protrusion 44 along the guide slot 24 and the auxiliary slot 25, the shank body 42 is movable along the stroke path (L). The hook end 423 has a hook cavity 421 which is configured such that the hook end 421 takes up one or both of a needle thread and a bobbin thread tensed in the thread fetching zone by engaging the thread(s) in the hook cavity 421 once the shank body 42 is moved along the stroke path (L) to reach a fetching position, as shown in FIGS. 5 and 6, and such that the cavity-engaging thread(s) is cut by virtue of sweeping movement of the hook end 421 relative to the blade 452 at a thread cutting position, as shown in FIG. 4.

The shank guiding member 46 is disposed on the upper major surface 21 adjacent to the cutout 26 of the marginal region 20 to further guide the movement of the shank body 42 along the stroke path (L). Thus, the movement of the movable knife in the longitudinal direction (X) is smooth and precise.

The rotation/translation conversion mechanism 5 includes a pivot axle 51, a rotary unit 52, a pinion 53, and the key 43.

The pivot axle 51 is mounted on the mount 2 and extends downwardly from the lower major surface 22. The rotary unit 52 is rotatably mounted on the pivot axle 51 and has driving and driven regions 521, 524 angularly spaced apart from each other about the pivot axle 51. A toothed rim segment 54 is formed on the driven region 524. In this embodiment, the rotary unit 52 includes a central region which is configured to be rotatably mount on the pivot axle 51, and which has an upper central half 523 integrally formed with the driving region 521, and a lower central half 522 integrally formed with the driven region 524 and the toothed rim segment 54 and non-rotatably superimposed under the upper central half 523. The driving region 521 has a slidable slot 526 extending radially of the pivot axle 51.

The pinion 53 is mounted on and is rotated with the output shaft 32, and is configured to mesh with the toothed rim segment 54 so as to transmit the rotational force of the drive unit 3 to turn the rotary unit 52.

The key 43 is loosely engaged in the slidable slot 526 such that turning of the rotary unit 52 brings the key 43 to guidingly move along the guide slot 24 so as to convert the rotational force of the output shaft 32 into a translational force that is transmitted through the guide slot 24 to move the shank body 42 between the fetching and thread cutting positions.

When it is desired to cut one or both of a needle thread and a bobbin thread, the motor 3, such as a step motor, is actuated to rotate the output shaft 32 in a clockwise direction so as to turn the rotary unit 52 about the pivot axle 51, thereby moving the movable knife along the stroke path (L) to permit the hook end 423 to take up the thread(s) by engaging the thread(s) in the hook cavity 421. Thereafter, the output shaft 32 is rotated in a counterclockwise direction to turn the rotary unit 52 in an opposite direction, thereby moving the movable knife to cut the cavity-engaging thread(s) by virtue of sweeping movement of the hook end 423 relative to the blade 452.

As illustrated, by means of the drive unit 3 which may be a motor, and by means of the rotation/translation conversion mechanism 5, the movable knife can be moved for cutting one or both of a needle thread and a bobbin thread. Additionally, the thread cutting device of this invention has a simple construction with a fewer number of components and is easy to fabricate at a relatively low manufacturing cost. Moreover, by virtue of the guide slot 24, the auxiliary slot 25, and the shank guiding member 46, the shank body 42 of the movable knife can be moved smoothly and precisely.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A thread cutting device for a sewing machine which includes a table fitted with a needle plate, and a hook assembly spaced apart from the needle plate in an upright direction to define a thread fetching zone, comprising:

a mount adapted to be mounted under the table of the sewing machine, and having a marginal region which extends in a direction transverse to the upright direction, and which is disposed to confront the thread fetching zone, said mount having a lower major surface and an upper major surface which defines a stroke path that extends toward said marginal region in a longitudinal direction transverse to the upright and transverse directions, said upper major surface having a guide slot which extends through said lower major surface, and which extends parallel to said stroke path;

a fixed knife disposed on said marginal region and including a blade which is oriented in alignment with said stroke path;

a movable knife including a shank body which extends in the longitudinal direction to terminate at an actuated end and a hook end that has a hook cavity, and which is disposed to be movable along said stroke path between a fetching position, where said hook end takes up a thread tensed in the thread fetching zone by engaging the thread in said hook cavity, and a thread cutting position, where the cavity-engaging thread is cut by virtue of sweeping movement of said hook end relative to said blade;

a drive unit with an output shaft disposed under said lower major surface of said mount to deliver a rotational force; and a rotation/translation conversion mechanism which is disposed to convert the rotational force into a translational force, and which is configured to transmit the translation force through said guide slot so as to actuate a translation of said actuated end of said movable knife to thereby move said shank body between the fetching and thread cutting positions, wherein said rotation/translation conversion mechanism includes:

a pivot axle mounted on said mount and extending downwardly from said lower major surface, a rotary unit rotatably mounted on said pivot axle and having driving and driven regions angularly spaced apart from each other about said pivot axle, said driven region being coupled with said output shaft to receive the rotational force to turn said driving region about said pivot axle, and a key coupled to said actuated end and extending through said guide slot to be engaged with said driving region of said rotary unit such that turning of said driving region brings said key to guidingly move along said guide slot so as to move said shank body between the fetching and thread cutting positions.

2. The tread cutting device according to claim 1, wherein said rotation/translation conversion mechanism further includes a toothed rim segment formed on said driven region, and a pinion which is mounted on and rotated with said output shaft, and which is configured to mesh with said toothed rim segment so as to transmit the rotational force to turn said driving region.

3. The thread cutting device according to claim 2, wherein said driving region of said rotary unit has a slidable slot which extends radially of said pivot axle and which is loosely engaged with said key to permit movement of said key in the longitudinal direction when turned about said pivot axle.

4. The thread cutting device according to claim 2, wherein said rotary unit includes a central region which is configured to be rotatably mount on said pivot axle, and which has an upper central half integrally formed with said driving region, and a lower central half integrally formed with said driven region and said toothed rim segment and superimposed under said upper central half.

5. The thread cutting device according to claim 1, wherein said movable knife has left and right wing portions extending from said actuated end in the transverse direction, said key being mounted on and extending downwardly from said left wing portion, said upper major surface has an auxiliary slot extending parallel to said stroke path, said movable knife further including a protrusion which is mounted on and extends downwardly from said right wing portion to be engaged in and slidable along said auxiliary slot so as to stabilize movement of said shank body in the longitudinal direction.

6. The thread cutting device according to claim 5, further comprising a shank guiding member which is disposed on said upper major surface adjacent to said marginal region to guide movement of said shank body between the fetching and thread cutting positions.

* * * * *